United States Patent [19]

Collins

[11] Patent Number: 4,854,044

[45] Date of Patent: Aug. 8, 1989

[54] KNIFE AND SHEATH

[75] Inventor: Walter W. Collins, North, S.C.

[73] Assignee: Wenoka Seastyle-Div. of Schur, Inc., West Palm Beach, Fla.

[21] Appl. No.: 115,059

[22] Filed: Oct. 30, 1987

[51] Int. Cl.[4] ..... B26B 29/02

[52] U.S. Cl. ..... 30/151

[58] Field of Search ..... 30/151, 159, 160, 161, 30/143, 162, 339

[56] References Cited

U.S. PATENT DOCUMENTS

| | | | |
|---|---|---|---|
| 2,391,574 | 12/1945 | Housinger | 30/151 |
| 2,901,823 | 9/1959 | Widen | 30/151 |
| 4,404,747 | 9/1983 | Collins | 30/151 |

*Primary Examiner*—Frank T. Yost
*Assistant Examiner*—Eugenia A. Jones
*Attorney, Agent, or Firm*—Wolf, Greenfield & Sacks

[57] ABSTRACT

A knife and sheath in combination in which a two-headed bolt supported in the knife handle may be positioned to interlock with the sheath. The bolt is symmetrical with respect to the knife to permit insertion of the knife into the sheath in either direction. The sheath has a portion of a resilient flexible wall positioned to engage one head of the bolt to urge the other into a hole in the other side of the sheath to secure the knife within the sheath until the bolt is pushed firmly in the opposite direction to disengage the knife and the sheath.

4 Claims, 2 Drawing Sheets

KNIFE AND SHEATH

SUBJECT MATTER OF THE INVENTION

The present invention relates to a knife and sheath combination.

BACKGROUND OF THE INVENTION

Knife and sheath combinations heretofore in use do not provide a fully satisfactory means for securely holding a knife in a sheath while still permitting a quick release of the knife when desired. Those features are particularly important for sporting uses such as for underwater divers who must be able to insert and remove a knife from a sheath quickly and efficiently while still being assured that the knife will not inadvertently slip from the sheath.

One style of knife and sheath combination heretofore available provides a sheath with a simple blade receiving pocket that holds the blade in frictional engagement. Such a combination is not satisfactory since underwater movement can cause the blade to lose frictional engagement with the sheath and slide from it.

Another form of a knife and sheath combination provides a strap that is secured around the knife handle, usually by a snap fastener or the like. Those arrangements are not fully satisfactory because the snap is not always properly fastened securely, and because the user will frequently fumble with the snap, especially if the user is operating under conditions in which he cannot readily look at the sheath as he is snapping the strap over the knife handle. Other combinations are shaped to require insertion of the knife in one direction only.

SUMMARY OF INVENTION

It is an object of the present invention to provide a knife and sheath combination that is simple and inexpensive to make, and securely holds the knife in the sheath when it is suppose to be secured, while providing means for quick release at an appropriate time.

A further object of this invention is to provide a knife and sheath combination which can be used by either a right or left handed person and with the knife capable of being inserted in the sheath with either the blade facing forwardly or facing rearwardly.

Another object of the present invention is to provide an improved knife and sheath combination which is particularly adapted for underwater uses, and in which the knife may be released readily from the sheath on positive movement by the individual wearing the sheath of a release mechanism.

A still further object of the present invention is to provide an improved one piece sheath injection molded and formed in a single operation.

A still further object of the present invention is to provide a means for automatically locking a knife in a sheath as the knife is inserted into the sheath with the knife being locked on both sides of the handle simultaneously.

A still further object of the present invention is ot provide an improved interlock means for a handle and a sheath which may be adapted for a knife;.

A further object of this invention is to provide an improved sheath construction for use with a knife or a tool having a handle with an attached tool capable of being carried within a sheath. Such other tools include, for example, pry bars, screw drivers, small saws, and the like.

The present invention provides a sheath and knife or other tool combination having a releasably interlocking means which, in its preferred embodiment, consists essentially of a hole that extends transversely the knife handle, with a bolt positioned in the hole for axial movement to and from a position in which one end of the bolt projects beyond the side wall of the knife. A sheath with opposite walls has a hole aligned with and normally receiving one end of the bolt in one wall, while the knife is in a fully inserted position. The other wall functions as a leaf spring and normally urges the bolt to the positioned described.

DESCRIPTION OF DRAWINGS

The foregoing objects and advantages of the present invention will be more clearly understood in connection with the accompanying drawings in which.

DETAILED DESCRIPTION OF THE INVENTION

Figure 1:
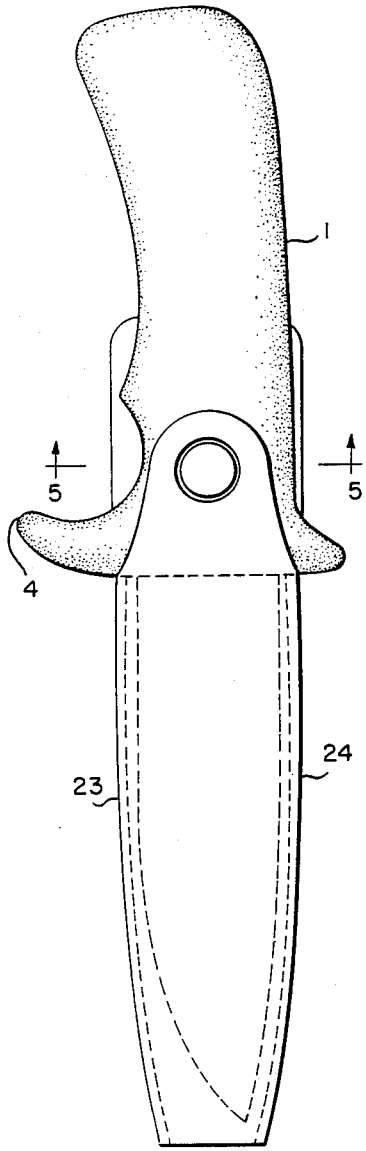
FIG. 1 is a plan elevation of the combination comprising a knife and a sheath embodying this invention.

In the preferred embodiment of this invention, a knife 1 having a handle 2 and blade 3 is shaped to be secured with the blade within a sheath 10. The knife handle 2 may be molded of any suitable plastic material about the upper end of the blade 3 in a conventional fashion. The knife handle may take any desired shape. In the preferred embodiment illustrated, the knife is designed as a diver's knife and consequently has a projecting hilt 4. A hole 5 extends through the upper end of the metal blade in the shank of the blade about which the handle is molded. This hole should preferably be in the order of ¼ inch in diameter. The lower end of the blade has a knife cutting edge 6 and a rear edge 7. If desired however, double edged knives and other shapes may be used. In the prefferred embodiment, the blade should be symmetrical below the bolt of the handle to permit insertion of the blade in either direction into the sheath. The invention also contemplates the use of a tool other than a knife. Consequently, the lower end of the knife blade may be replaced with a different tool, such as a screw driver, pry, awl, double saw, or other suitable this element that is capable of being secured to a handle. The handle 2 is molded about the upper end of the knife blade with a hole 8 having a diameter greater than the diameter of hole 5. The diameter of hole 8 may be in the order of ½ inch. The blade 3 is molded symmetrically with respect to the handle 2 and therefore, forms an annular ring 9 that projects into and bisects the hole 8, thus forming a symmetrical shoulder 11 in the hole 8.

Figure 5:
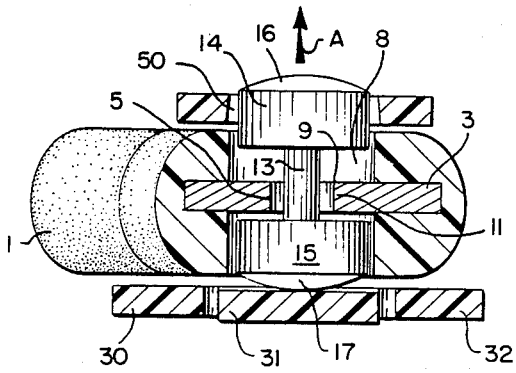
FIG. 5 is a cross-sectional view taken essentially along line 5—5 of FIG. 1.

A bolt 12 is formed with a shaft 13 and opposite enlarged heads 14 and 15. The heads 14 and 15 have an axial length that is greater than the length of the hole 8 on either side of the annular ring 9. The length of the shaft 13 is approximately twice the thickness of the blade 3 at the hole 5. The overall length of the bolt is greater than the thickness of the handle. Thus, as illustrated in FIG. 5, the bolt 12 may be reciprocated back and forth in the holes 8 with length of movement in each direction of the bolt being determined by interengagement of the annular ring 9 with the inner surfaces of the enlarged heads 14 and 15. Preferably, the enlarged heads are each formed with a button-like dome 16, 17.

Figure 2:
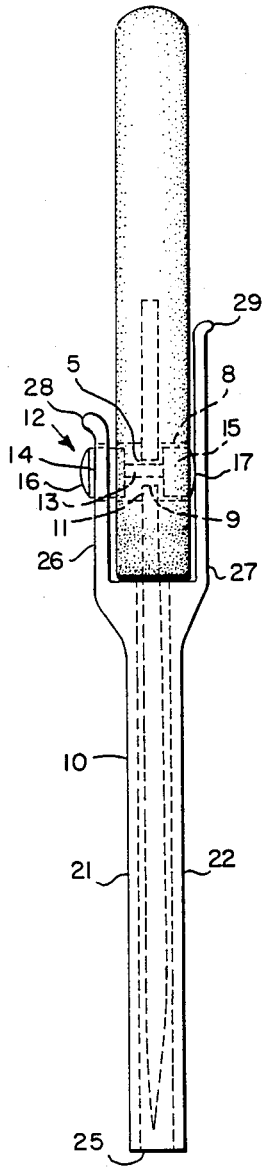
FIG. 2 is a plan elevation looking from the right of FIG. 1.
Figure 3:
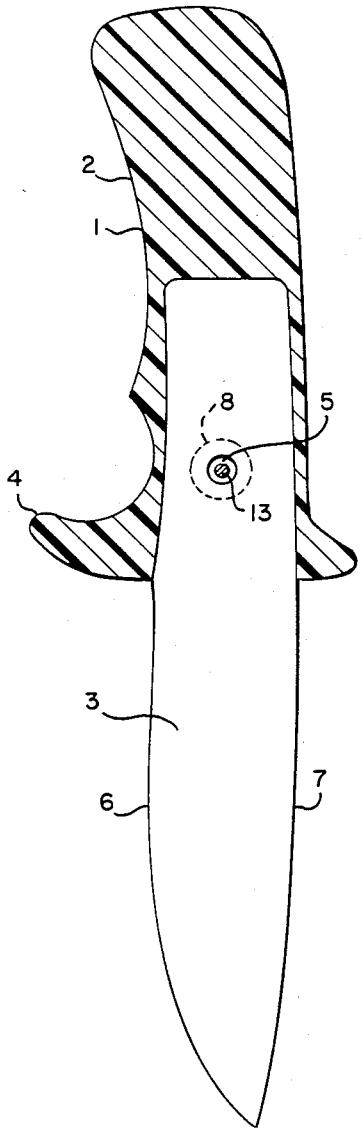
FIG. 3 is cross-sectional view of the knife alone.
Figure 4:
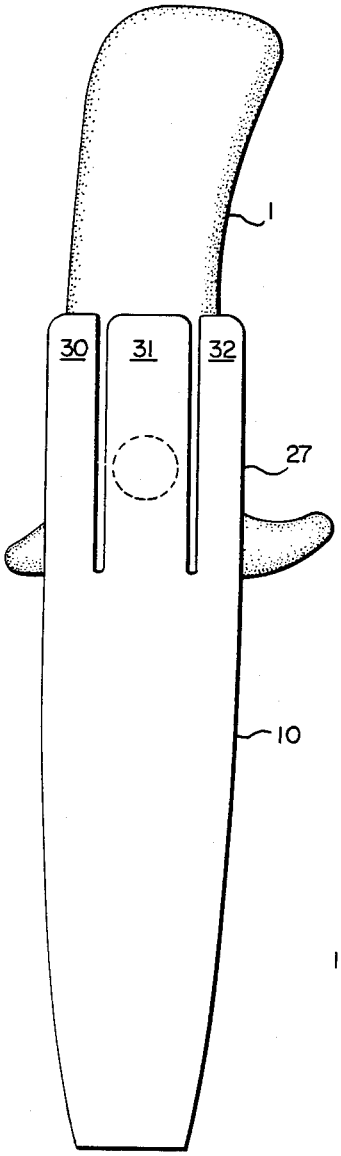
FIG. 4 is a view taken from the opposite side of FIG. 1.

The sheath 10 may be molded as a one piece unit from suitable material, such for example as a glass filled nylon Zytel. Any other suitable synthetic material that is shatter resistant, corrosive resistant, resistant to abrasion, and having resilience sufficient to permit flexing of the walls as hereinafter described may be used. The sheath is symmetrically formed with opposite side walls 21, 22 and end walls 23, 24. Preferably, the side walls and end walls are shaped and sized to receive the blade irrespective in the direction in which the blade is faced. The bottom of the sheath is preferably open as illustrated at 25. The upper end of the sheath has a front wall 26 and rear wall 27. These walls are spaced apart from one another, slightly more than the thickness of the handle 2 as illustrated in FIG. 2. If desired, the upper ends of the walls 26 and 27 may be outwardly flared as illustrated at 28 and 29 to facilitate the insertion of the knife blade. Front wall 26 may be formed as a unitary section, while rear wall, best illustrated in FIG. 4, is formed with three sections, 30, 31 and 32 extending upwardly, approximately half the height of the knife handle. The center section of the upper wall 27 engages the dome 17 and functions as a leaf spring, biasing the bolt 12 in the direction of arrow A. In this position, as illustrated in FIG. 5, the head 14 projects through an opening 50 in the upper wall 26 when the knife is fully inserted into the sheath. As so positioned, the knife is locked into the sheath and cannot be removed unless the operator first pushes against the dome 16 to cause the bolt to move in the direction opposite the arrow A until the head 14 is fully seated within the hole 8. In moving the bolt in the direction opposite the arrow A, the center or leaf spring section 31 of the sheath is forced outwardly against its inherent spring tension. When the head 14 clears the hole 8, the knife may be removed.

The sheath must be formed of a material in which the upper ends or walls of the sheath have spring-like functions, consequently molding this material of a relatively resilient spring-like material is essential. The material may comprise a DuPont Zytel material which is a nylon with a high glass fiber content.

Having thus described the invention, I claim:

1. A tool and sheath combination having releasably interlocking means comprising:

said tool having a handle with a hole extending through said handle, a lock bolt positioned in said hole for axial movement thereof to and from a position in which one end of said lock bolt projects beyond a sidewall of said handle, and said sheath having opposite walls with one wall having a hole aligned with and normally receiving said one end of said lock bolt when said tool is fully inserted in siad sheath, and means on the other wall of said sheath for engaging and normally urging the other end of said lock bolt to siad position comprising a resilient flexible wall section having leaf spring-like function whereby said one end of said lock bolt engages said hole in said one wall.

2. A tool and sheath as set forth in claim 1 wherein said bolt is formed with a center shaft and enlarged heads at either end, said hole in said one wall of said sheath having a diameter sufficient to receive and engage said heads.

3. A tool and sheath as set forth in claim 2 wherein said sheath is symmetrical.

4. In a knife and sheath combination, means for removably securing the knife in the sheath comprising:

said knife having a hole through the handle, means permanently securing a bolt in said hole for reciprocal axial movement, said bolt having an axial length greater than the thickness of said handle at said hole, means formed at least in part by said handle for permitting said bolt to be moved axially to and from positions in which the bolt selectively projects beyond either, but not both, sidewalls of said handle at one time, said sheath having lower walls to receive the knife blade and upper walls facing the sidewalls of said knife handle, one of said upper walls having a hole aligned with and adapted to receive one end of said bolt when the knife is fully inserted, and the other of said upper walls functioning as a leaf spring in engagement with the other end of said bolt for normally, biasing said bolt to one of said selective positions.

* * * * *